US009743177B2

(12) United States Patent
Lee

(10) Patent No.: US 9,743,177 B2
(45) Date of Patent: Aug. 22, 2017

(54) WATERPROOF STRUCTURE FOR MICROPHONE

(71) Applicant: TAIWANMIC INC., New Taipei (TW)

(72) Inventor: Wei-Chih Lee, New Taipei (TW)

(73) Assignee: TAIWANMIC INC., New Taipei (TW)

( * ) Notice: Subject to any disclaimer, the term of this patent is extended or adjusted under 35 U.S.C. 154(b) by 0 days.

(21) Appl. No.: 15/099,217

(22) Filed: Apr. 14, 2016

(65) Prior Publication Data

US 2017/0164104 A1 Jun. 8, 2017

(30) Foreign Application Priority Data

Dec. 8, 2015 (TW) ..... 104219655 U

(51) Int. Cl.
*H04R 25/00* (2006.01)
*H04R 1/44* (2006.01)
*H04R 1/34* (2006.01)

(52) U.S. Cl.
CPC ..... *H04R 1/44* (2013.01); *H04R 1/342* (2013.01)

(58) Field of Classification Search
USPC ..... 381/189, 334, 333, 308
See application file for complete search history.

(56) References Cited

U.S. PATENT DOCUMENTS

2012/0195455 A1* 8/2012 Chiba ..... H04R 1/1091 381/374
2015/0110320 A1* 4/2015 Liu ..... H04R 1/1016 381/322

* cited by examiner

*Primary Examiner* — Sunita Joshi
(74) *Attorney, Agent, or Firm* — Rabin & Berdo, P.C.

(57) ABSTRACT

A waterproof structure for a microphone includes a single-directional sound head disposed within an upper sleeve, which is disposed above a fixing seat having two fixing end portions, wherein a peripheral wall interconnecting the fixing end portions is formed with an insert hole. An empty tube is inserted into the insert hole in the fixing seat. Top and bottom covers are mounted respectively on the upper fixing end portion of the upper sleeve and a lower fixing end portion of the fixing seat, wherein each of the top and bottom covers is formed with a central through hole. Three pieces of breathable waterproof fabric are disposed between the top cover and the upper fixing end portion of the upper sleeve and another six pieces are disposed between the bottom cover and the lower fixing end portion of the fixing seat.

2 Claims, 4 Drawing Sheets

WATERPROOF STRUCTURE FOR MICROPHONE

CROSS-REFERENCE TO RELATED APPLICATION

This application claims the priority of Taiwanese patent application No. 104219655, filed on Dec. 8, 2015, which is incorporated herewith by reference.

BACKGROUND OF THE INVENTION

1. Field of the Invention

The present invention relates generally to a waterproof structure, and more particularly to a waterproof structure for a microphone which provides the best acoustic effect in a single direction.

2. The Prior Arts

A conventional single directional microphone is capable of receiving the best acoustic effect in a particular direction, and the acoustic effect will be attenuated in other directions and hence it can effectively suppress the acoustic sound from other directions so as to avoid the noise that may cause unbearable harsh noise in the ears.

The advance of electronic technology has promoted high living standard of human beings such that microphones have been widely used in our daily lives, especially in the entertainment fields, like TV commentator, speaker in auditorium and home theatres. Therefore, microphones have become indispensable gadgets in the lives of majority people. Of course, if the microphones are used outdoors, they may be damaged or the service life thereof may be shortened due to the reasons that the microphones are not provided waterproof effect, like due to soaking of sweat or rain water getting interior into the microphones. If the microphone is out of order, the whole set of microphone (including earplug and cables) must be discarded, this drawback can be avoided if the microphone is provided waterproof structure. To be more specific, if the speaker head, which constitutes as one part of the microphone, is installed with waterproof structure can incur extra manufacturing cost and is against the trend of cost down economic view.

SUMMARY OF THE INVENTION

A primary objective of the present invention is to provide a waterproof structure for a microphone, especially for a single directional microphone with waterproof effect.

A waterproof structure of the present invention for a microphone, includes: a fixing seat, an empty tube, an upper sleeve, a single-directional sound head, top and bottom covers and a plurality of breathable waterproof fabric. The fixing seat, in form of a hollow tube, has opposite upper and lower fixing end portions, wherein a peripheral wall interconnecting the upper and lower fixing end portions is formed with an insert hole. The empty tube is inserted into the insert hole in the peripheral wall of the fixing seat. The upper sleeve is disposed above the fixing seat, defines a receiving space therein and has an upper fixing end portion. The single-directional sound head is disposed within the receiving space of the upper sleeve so as to be seated on the upper fixing end portion of the fixing seat, wherein a signal line connected to the sound head extends through the empty tube for connection with a power source. The top and bottom covers are mounted respectively on the upper fixing end portion of the upper sleeve and the lower fixing end portion of the fixing seat, wherein each of the top and bottom covers is formed with a central through hole. The pieces of breathable waterproof fabric are disposed between the top cover and the upper fixing end portion of the upper sleeve and between the bottom cover and the lower fixing end portion of the fixing seat, thereby providing waterproof sealing effects between the top cover and the upper fixing end portion of the upper sleeve and between the bottom cover and the lower fixing end portion of the fixing seat.

After assembling the elements sequentially constituting the waterproof structure of the present invention, waterproof glue or gel can be coated on the assembly in order to provide the waterproof effects. In case of repairing, only the top cover is required to be removed from the upper sleeve so as to repair and/or replace the single-directional sound head.

In one embodiment of the present invention, three sheets of the breathable waterproof fabric are disposed respectively between the top cover and the upper fixing end portion of the upper sleeve and between the bottom cover and the lower fixing end portion of the fixing seat.

In one embodiment of the present invention, each of the upper and lower fixing end portions of the fixing seat and the upper fixing end portion of the upper sleeve is provided with outer threads while each of the top and bottom covers is provided with inner threads for fastened threadedly with the outer threads.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

Figure 1:
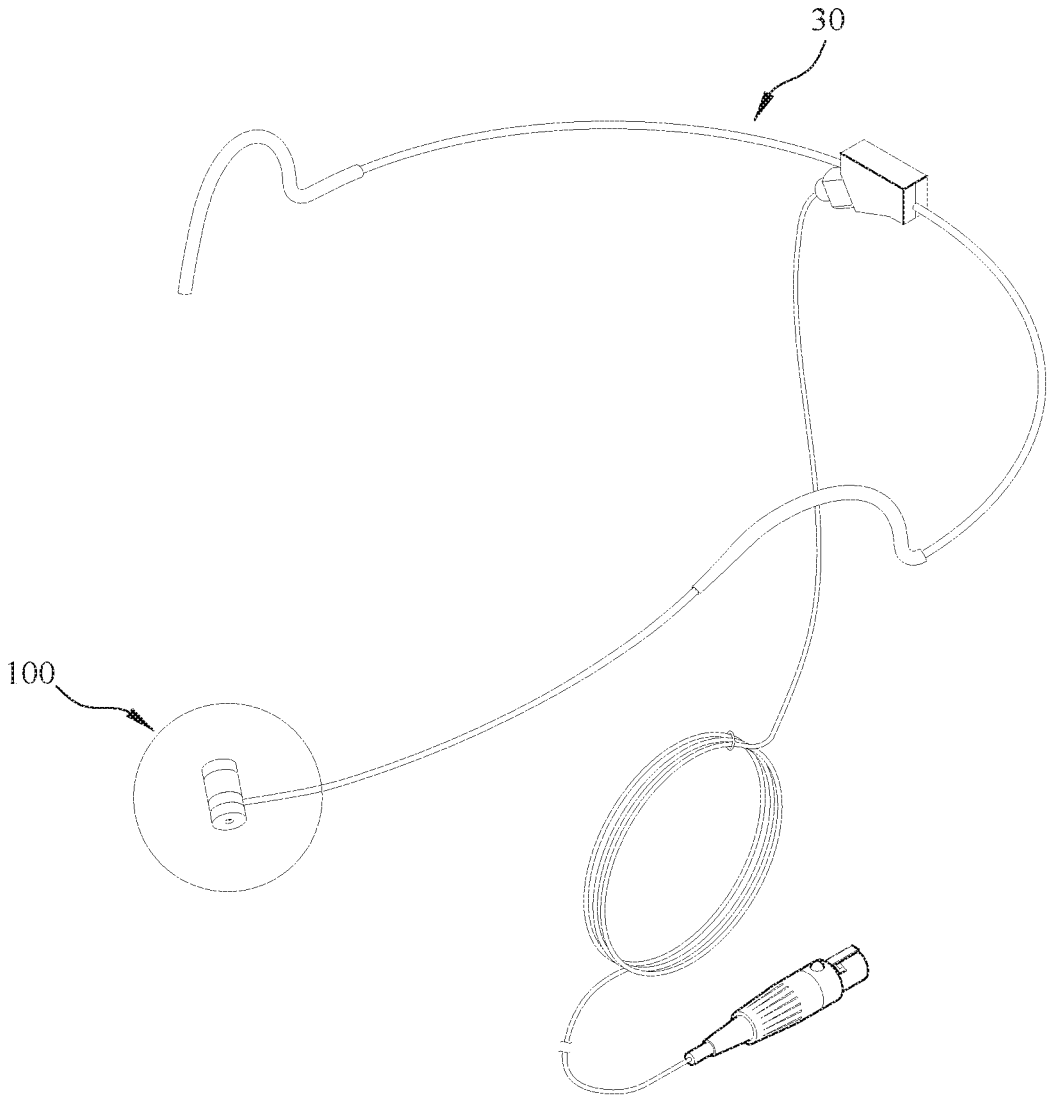
FIG. 1 illustrates a perspective view of a waterproof structure of the present invention for a single-directional microphone.
Figure 2:
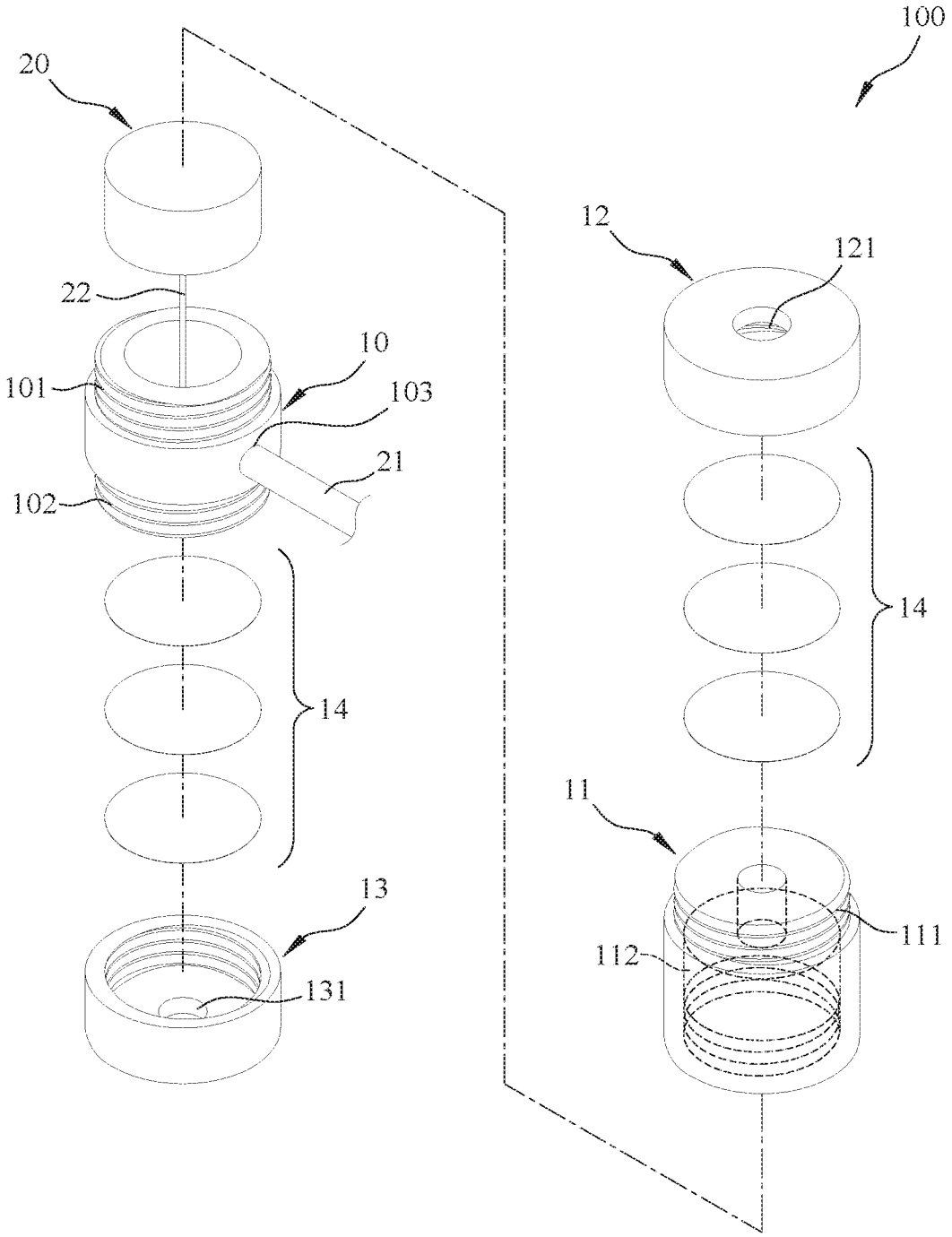
FIG. 2 is an exploded view the waterproof structure of the present invention for the single-directional microphone.

Referring to FIGS. 1 and 2, wherein FIG. 1 illustrates a perspective view of a waterproof structure of the present invention for a single-directional microphone and FIG. 2 is an exploded view the waterproof structure of the present invention for the single-directional microphone. As shown, the waterproof structure for a microphone according to the present invention includes a fixing seat 10 in form of a hollow tube, a single-directional sound head 20, an empty tube 21, an upper sleeve 11, top and bottom covers 12, 13 and six pieces of breathable waterproof fabric 14. The fixing seat 10 has opposite upper and lower fixing end portions 101, 102, wherein a peripheral wall interconnecting the upper and lower fixing end portions 101, 102 is formed with an insert hole 103. The empty tube 21 is inserted into the insert hole 103 in the peripheral wall of the fixing seat 10. The upper sleeve 11 is disposed above the fixing seat 10, defines a receiving space 112 therein and has an upper fixing end portion 111. The single-directional sound head 20 is disposed within the receiving space 112 of the upper sleeve 11 so as to be seated on the upper fixing end portion 101 of the fixing seat 10, wherein a signal line 22 connected to the sound head 20 extends through the empty tube 21 for connection with a power source (not visible) via a plug. In this embodiment, welding or soldering means is used for fixing the empty tube 21 into the insert hole 103 in the peripheral wall of the fixing seat 10, but the fixing method should not be limited only thereto.

In one embodiment of the present invention, three pieces of breathable waterproof fabric 14 are disposed between the top cover 12 and the upper fixing end portion 111 of the upper sleeve 11 while another three pieces of breathable waterproof fabric 14 are disposed between the bottom cover 13 and the lower fixing end portion 102 of the fixing seat 10, thereby providing a waterproof sealing effect between the top cover 12 and the upper fixing end portion of the upper sleeve 11 and between the bottom cover 13 and the lower fixing end portion 102 of the fixing seat 10.

Figure 3:
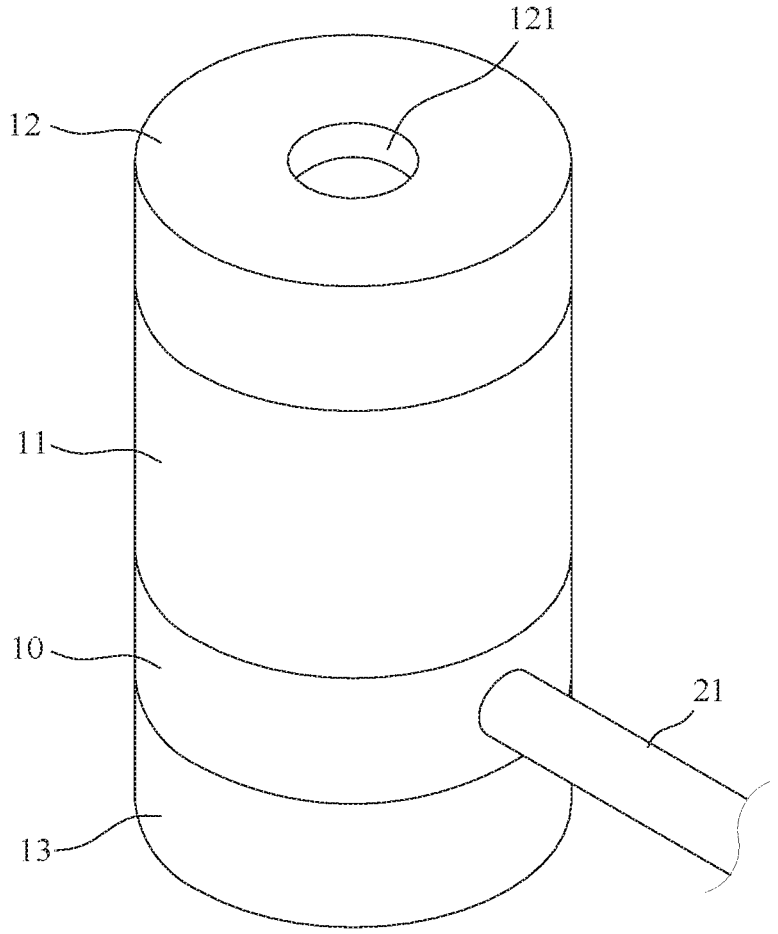
FIG. 3 is assembled view of the waterproof structure of the present invention for the single-directional microphone.
Figure 4:
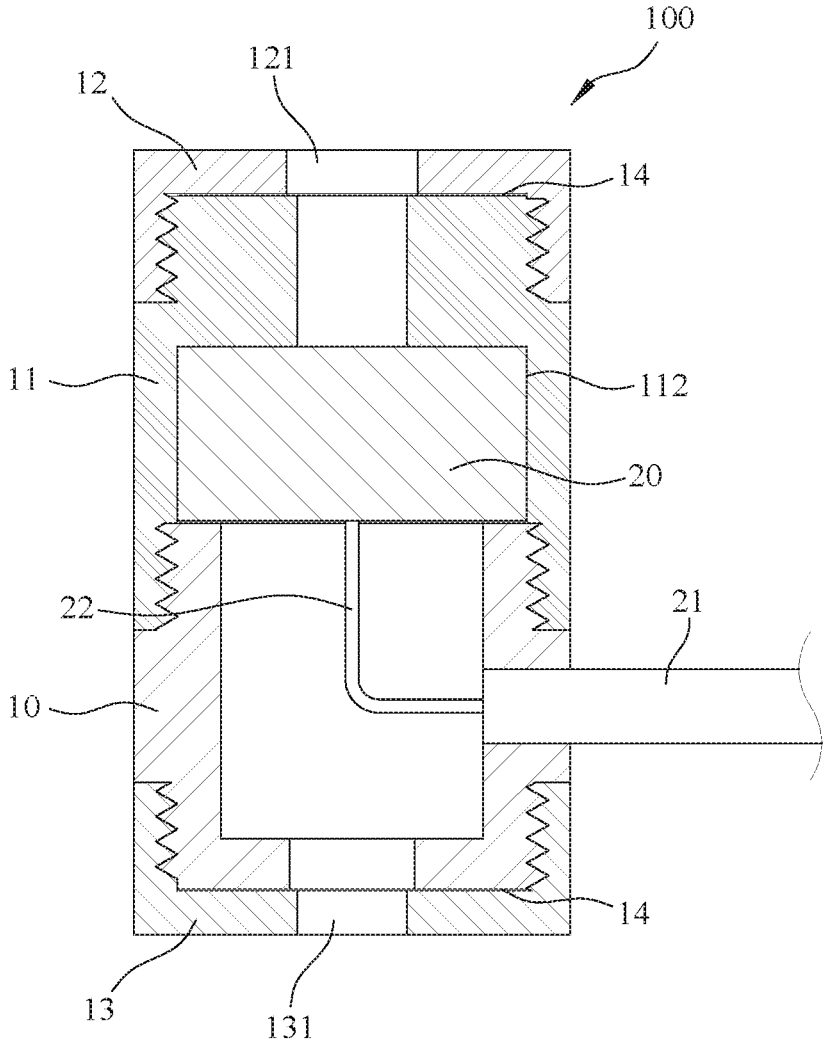
FIG. 4 is a cross-sectional view of the waterproof structure of the present invention for the single-directional microphone.

Referring to FIGS. 3 and 4, wherein FIG. 3 is assembled view of the waterproof structure of the present invention for the single-directional microphone and FIG. 4 is a cross-sectional view of the waterproof structure of the present invention for the single-directional microphone. As shown, the top and bottom covers 12, 13 are mounted respectively on the upper fixing end portion of the upper sleeve 11 and the lower fixing end portion of the fixing seat 10, wherein each of the top and bottom covers 12, 13 is formed with a central through hole 121, 131. In this embodiment, each of the upper and lower fixing end portions 101, 102 of the fixing seat 10 and the upper fixing end portion 111 of the upper sleeve 11 is provided with outer threads while each of the top and bottom covers 12, 13 is provided with inner threads for threadedly fastened with the outer threads.

After assembling the elements sequentially constituting the waterproof structure of the present invention, waterproof glue or gel can be coated on the assembly in order to provide the waterproof effects. Since the breathable waterproof fabrics 14 are located on two opposite side of the single-directional sound head 20, water cannot get interior of the waterproof structure 100 via the gaps formed between or among the elements. In case of repairing, only the top cover 12 is required to be removed from the upper sleeve 11 so as to repair and/or replace the single-directional sound head 20.

FIG. 1 illustrates the single-directional microphone 100 provided with the waterproof structure of the present invention that includes a set of earplug 30, the element constituting the microphone provided with the waterproof structure can be varied according to the user's wishes or usage.

Note that in addition to the waterproof coating glue or gel at the exterior of the microphone 100 of the present invention and since three pieces of the breathable waterproof fabric 14 are disposed respectively between the top cover 12 and the upper fixing end portion of the upper sleeve 11 and between the bottom cover 13 and the lower fixing end portion 102 of the fixing seat 10, no water can get interior of the single-directional microphone 20 when the latter is used outdoors due to rain or sweat, thereby preventing damage done onto the same.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A waterproof structure for a microphone, comprising:

a fixing seat in form of a hollow tube having opposite upper and lower fixing end portions, wherein a peripheral wall interconnecting said upper and lower fixing end portions is formed with an insert hole;

an empty tube inserted into said insert hole in said peripheral wall of said fixing seat;

an upper sleeve disposed above said fixing seat, defining a receiving space therein and having an upper fixing end portion;

a single-directional sound head disposed within said receiving space of said upper sleeve so as to be seated on said upper fixing end portion of said fixing seat, wherein a signal line connected to said sound head extends through said empty tube for connection with a power source;

top and bottom covers mounted respectively on said upper fixing end portion of said upper sleeve and said lower fixing end portion of said fixing seat, wherein each of said top and bottom covers is formed with a central through hole; and a plurality of breathable waterproof fabric disposed between said top cover and said upper fixing end portion of said upper sleeve and between said bottom cover and said lower fixing end portion of said fixing seat, thereby providing a waterproof sealing effect between said top cover and said upper fixing end portion of said upper sleeve and between said bottom cover and said lower fixing end portion of said fixing seat, wherein three sheets of said breathable waterproof fabric are disposed respectively between said top cover and said upper fixing end portion of said upper sleeve and between said bottom cover and said lower fixing end portion of said fixing seat.

2. A waterproof structure for a microphone, comprising:

a fixing seat in form of a hollow tube having opposite upper and lower fixing end portions, wherein a peripheral wall interconnecting said upper and lower fixing end portions is formed with an insert hole;

an empty tube inserted into said insert hole in said peripheral wall of said fixing seat;

an upper sleeve disposed above said fixing seat, defining a receiving space therein and having an upper fixing end portion;

a single-directional sound head disposed within said receiving space of said upper sleeve so as to be seated on said upper fixing end portion of said fixing seat, wherein a signal line connected to said sound head extends through said empty tube for connection with a power source;

top and bottom covers mounted respectively on said upper fixing end portion of said upper sleeve and said lower fixing end portion of said fixing seat, wherein each of said top and bottom covers is formed with a central through hole; and a plurality of breathable waterproof fabric disposed between said top cover and said upper fixing end portion of said upper sleeve and between said bottom cover and said lower fixing end portion of said fixing seat, thereby providing a waterproof sealing effect between said top cover and said upper fixing end portion of said upper sleeve and between said bottom cover and said lower fixing end portion of said fixing seat, wherein each of said upper and lower fixing end portions of said fixing seat and said upper fixing end portion of said upper sleeve is provided with outer threads while each of said top and bottom covers is provided with inner threads for threadedly fastened with said outer threads.

* * * * *